US008931686B2

(12) United States Patent
Brundage et al.

(10) Patent No.: US 8,931,686 B2
(45) Date of Patent: Jan. 13, 2015

(54) POLYGONAL CONTAINERS HAVING A LOCKING BOTTOM AND BLANKS AND METHODS FOR FORMING THE SAME

(75) Inventors: David Joe Brundage, Salinas, CA (US); Kenneth C. Smith, Hiram, GA (US)

(73) Assignee: Rock-Tenn Shared Services LLC, Norcross, GA (US)

( * ) Notice: Subject to any disclaimer, the term of this patent is extended or adjusted under 35 U.S.C. 154(b) by 537 days.

(21) Appl. No.: 12/709,217

(22) Filed: Feb. 19, 2010

(65) Prior Publication Data

US 2011/0204127 A1 Aug. 25, 2011

(51) Int. Cl.

| | |
|---|---|
| ***B65D 5/10*** | (2006.01) |
| ***B31B 1/26*** | (2006.01) |
| ***B65D 5/00*** | (2006.01) |
| ***B65D 5/42*** | (2006.01) |

(52) U.S. Cl.
CPC *B65D 5/10* (2013.01); *B65D 5/001* (2013.01); *B65D 5/103* (2013.01); *B65D 5/4295* (2013.01)
USPC ..... 229/109; 229/155; 229/185; 493/162; 493/183

(58) Field of Classification Search
USPC ..... 229/109, 155, 156, 157, 185; 493/162, 493/183
See application file for complete search history.

(56) References Cited

U.S. PATENT DOCUMENTS

| | | | | |
|---|---|---|---|---|
| 1,653,116 | A | 12/1927 | Parks | |
| 2,295,141 | A | 9/1942 | Van Wingen | |
| 3,770,187 | A * | 11/1973 | Faires et al. | 229/185 |
| 4,013,213 | A * | 3/1977 | Giebel | 229/158 |
| 4,068,796 | A | 1/1978 | Kullman, Jr. | |
| 4,260,100 | A * | 4/1981 | Hoffman | 229/109 |
| 5,294,044 | A | 3/1994 | Clark | |
| 5,775,575 | A * | 7/1998 | Dorman et al. | 229/157 |
| 6,296,178 | B1 | 10/2001 | McKenna, Sr. | |
| 6,460,758 | B1 | 10/2002 | Fenton et al. | |
| 6,508,395 | B2 | 1/2003 | McLeod | |
| 6,641,032 | B1 | 11/2003 | Schilling | |
| 6,676,012 | B1 | 1/2004 | Southwell et al. | |
| 6,899,266 | B2 | 5/2005 | Conway | |
| 7,000,771 | B2 | 2/2006 | Kwong | |
| 7,290,696 | B2 | 11/2007 | McClure | |
| 7,484,655 | B2 | 2/2009 | McLeod | |
| 7,607,567 | B2 | 10/2009 | Fry et al. | |
| 2002/0121542 | A1 * | 9/2002 | Holladay | 229/109 |
| 2002/0158114 | A1 * | 10/2002 | Evans et al. | 229/109 |
| 2003/0024971 | A1 * | 2/2003 | Jones et al. | 229/109 |
| 2004/0211825 | A1 | 10/2004 | Champion et al. | |
| 2004/0256448 | A1 | 12/2004 | Blomfield et al. | |
| 2005/0011938 | A1 * | 1/2005 | West | 229/109 |

(Continued)

OTHER PUBLICATIONS http://sierrapack.com/fci.html; "1-2-3 Houghland Snap Lock Bottom"; Paperboard Packaging Council Handbook of Folding Carton Style Nomenclature; 1 page, Feb. 2010.

(Continued)

*Primary Examiner* — Gary Elkins
(74) *Attorney, Agent, or Firm* — Armstrong Teasdale LLP

(57) ABSTRACT

A blank of sheet material for forming a polygonal container is provided. The blank includes two end panels, two side panels, and four corner panels connected in series along a plurality of fold lines. The blank further includes a plurality of bottom panels each extending from one panel of the end panels and the side panels. The plurality of bottom panels is configured to define a locking slot and a locking tab that is insertable into the locking slot to form a bottom wall of the container.

23 Claims, 7 Drawing Sheets

(56) References Cited

U.S. PATENT DOCUMENTS

| | | | | |
|---|---|---|---|---|
| 2005/0284922 | A1* | 12/2005 | Feltz | 229/109 |
| 2007/0131746 | A1* | 6/2007 | Quaintance et al. | 229/109 |
| 2007/0152027 | A1* | 7/2007 | Hyatt et al. | 229/109 |
| 2008/0078819 | A1* | 4/2008 | Strong et al. | 229/109 |
| 2008/0110964 | A1 | 5/2008 | Churvis | |
| 2008/0116249 | A1* | 5/2008 | West | 229/109 |
| 2009/0098991 | A1 | 4/2009 | Graham et al. | |
| 2010/0065620 | A1* | 3/2010 | Smith | 229/109 |

OTHER PUBLICATIONS http://sierrapack.com/fci.html; Sierra Packaging—Manufacturer of Custom Folding Cartons; Folding Carton Information; 6 pages, Dec. 2009.

U.S. Appl. No. 12/209,949, filed Sep. 12, 2008; titled "Container Having an Automatically Locking Bottom and Blanks for Making the Same"; 42 pages.

* cited by examiner

POLYGONAL CONTAINERS HAVING A LOCKING BOTTOM AND BLANKS AND METHODS FOR FORMING THE SAME

BACKGROUND OF THE INVENTION

The field of the invention relates generally to a polygonal container and, more particularly, to a non-rectangular container having a bottom wall formed from a plurality of interlocked bottom panels.

At least some known containers are four-sided and include a bottom wall formed from a plurality of interlocked bottom panels. The interlocking bottom panels enable the rectangular container to be finally formed without using adhesives and/or tapes. However, rectangular-shaped containers are oftentimes not suitable for a packaging application. Specifically, the item to be packed and shipped may not be rectangular and, therefore, a rectangular-shaped package may lack the desired space efficiency. Furthermore, a rectangular-shaped package may lack sufficient strength for stacking or bulge resistance. In these types of packaging applications, a shipping container having a non-rectangular configuration is better suited.

Accordingly, it is desirable to provide a non-rectangular container having a bottom wall formed from interlocking bottom panels.

BRIEF DESCRIPTION OF THE INVENTION

In one aspect, a blank of sheet material for forming a polygonal container is provided. The blank includes two end panels, two side panels, and four corner panels connected in series along a plurality of fold lines. The blank further includes a plurality of bottom panels each extending from one panel of the end panels and the side panels. The plurality of bottom panels is configured to define a locking slot and a locking tab that is insertable into the locking slot to form a bottom wall of the container.

In another aspect, a container formed from a blank of sheet material is provided. The container includes two end walls, two side walls, and four corner walls connected in series along a plurality of fold lines. The container further includes a bottom wall formed from a plurality of bottom panels each extending from one wall of the end walls and the side walls. The plurality of bottom panels is configured to define a locking slot and a locking tab that is insertable into the locking slot to form the bottom wall.

In yet another aspect, a method for forming a container from a blank of sheet material is provided. The method includes rotating a plurality of panels about a plurality of fold lines to form a first side wall, an opposing second side wall, a first end wall, an opposing second end wall, and a plurality of corner walls. A plurality of bottom panels is rotated with respect to the plurality of panels to form a bottom wall. The plurality of bottom panels defines a locking slot and a locking tab insertable into the locking slot.

BRIEF DESCRIPTION OF THE DRAWINGS

FIG. 1 is a top plan view of an exemplary blank of sheet material.

FIG. 2 is a top perspective view of a container formed from the blank shown in FIG. 1.

FIG. 3 is a top perspective view of the container shown in FIG. 2 with a top wall formed.

FIG. 4 is a bottom perspective view of the container shown in FIG. 2.

FIG. 5 is a top plan view of a first alternative blank of sheet material.

FIG. 6 is a top perspective view of a container formed from the blank shown in FIG. 5.

FIG. 7 is a top perspective view of the container shown in FIG. 6 with a top wall formed.

DETAILED DESCRIPTION OF THE INVENTION

Figure 1:
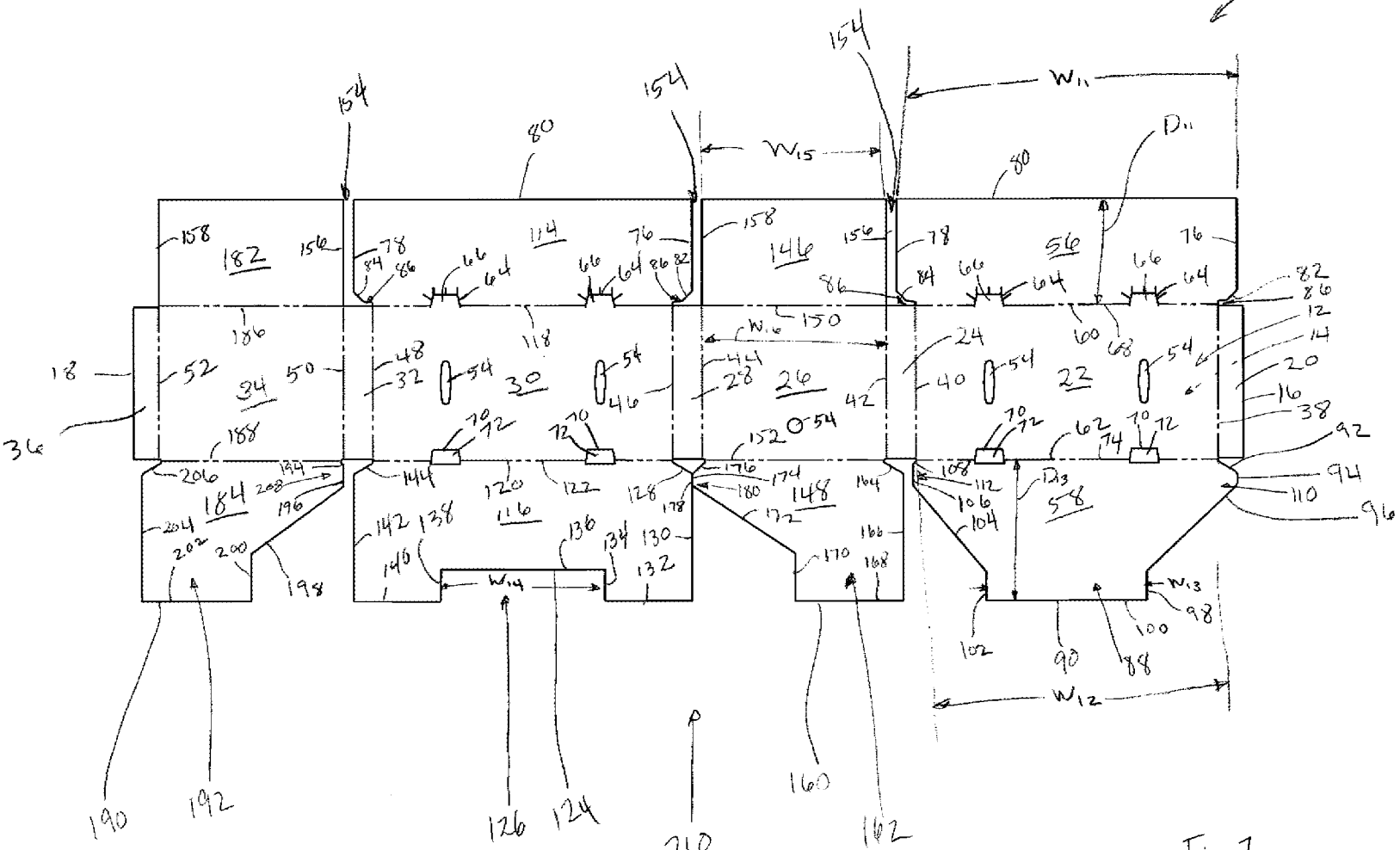
FIGS. 1-7 show exemplary embodiments of the apparatus and methods described herein.

The following detailed description illustrates the disclosure by way of example and not by way of limitation. The description clearly enables one skilled in the art to make and use the disclosure, describes several embodiments, adaptations, variations, alternative, and use of the disclosure, including what is presently believed to be the best mode of carrying out the disclosure.

The present invention provides a non-rectangular container that includes locking bottom panels, and a method for constructing the container. The container is constructed from a blank of sheet material using a machine. For example, the blank can be wrapped about a mandrel to form a knocked-down flat container, and the final construction of the container can be performed by hand and/or by another machine. In one embodiment, the container is fabricated from a paperboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In the exemplary embodiments, the non-rectangular container includes a plurality of bottom panels that interlock to form a bottom wall. More specifically, the bottom panels define a locking slot and a locking tab that is insertable into the locking slot for securing the bottom panels together. In particular embodiments, the non-rectangular container is octagonal-shaped and has four corner walls in addition to two side walls and two end walls.

In one embodiment, the container and/or a blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In particular embodiments, the container includes a shape that provides functionality, such as a shape that facilitates packaging a food item, a shape that facilitates transporting the container, and/or a shape that facilitates stacking and/or arrangement of a plurality of containers.

Further, different embodiments described here can vary in size and/or dimensions although similar labels are used for each embodiment. For example, although a depth is labeled similarly throughout the description, each embodiment can have varying depths.

Figure 2:
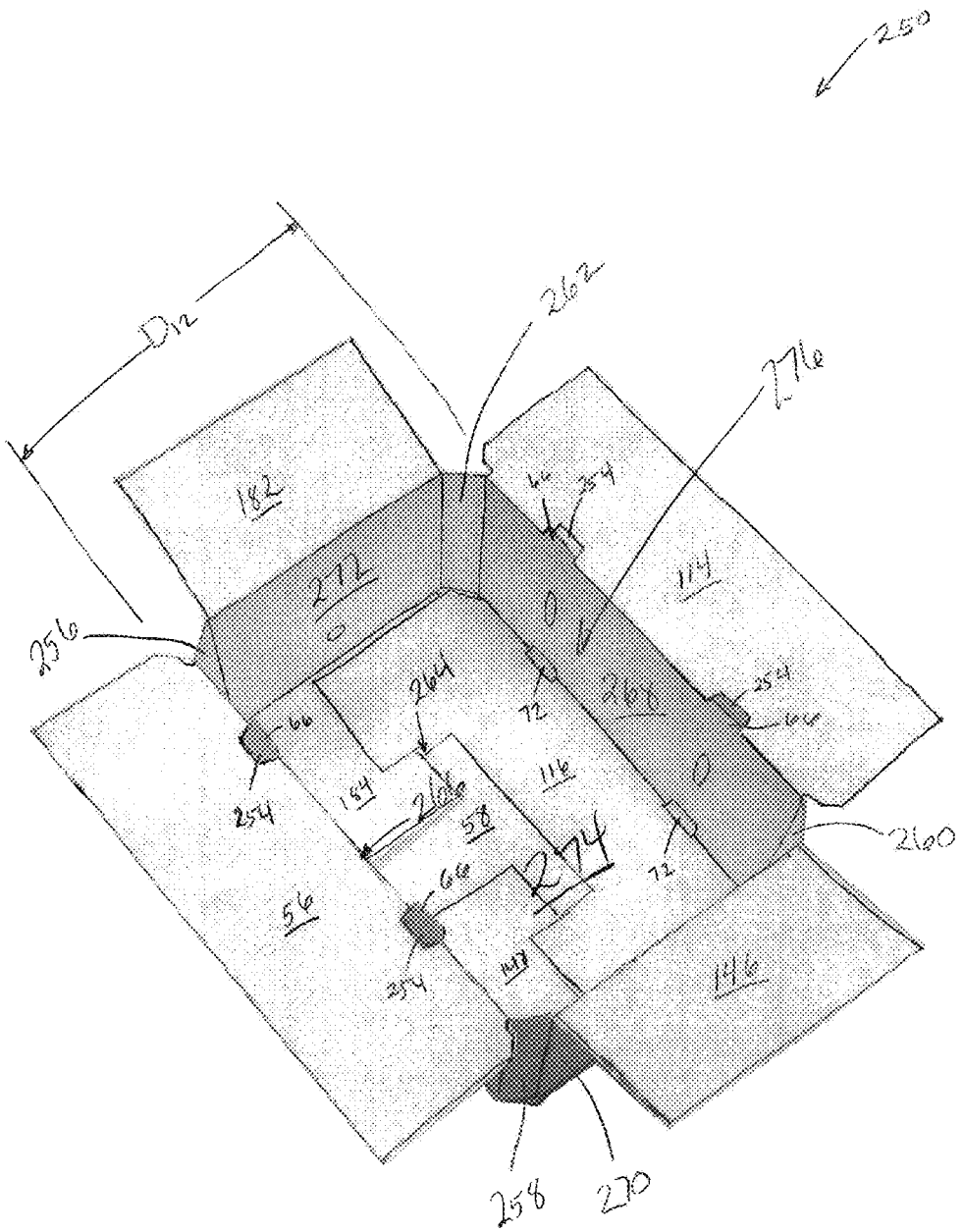
Figure 3:
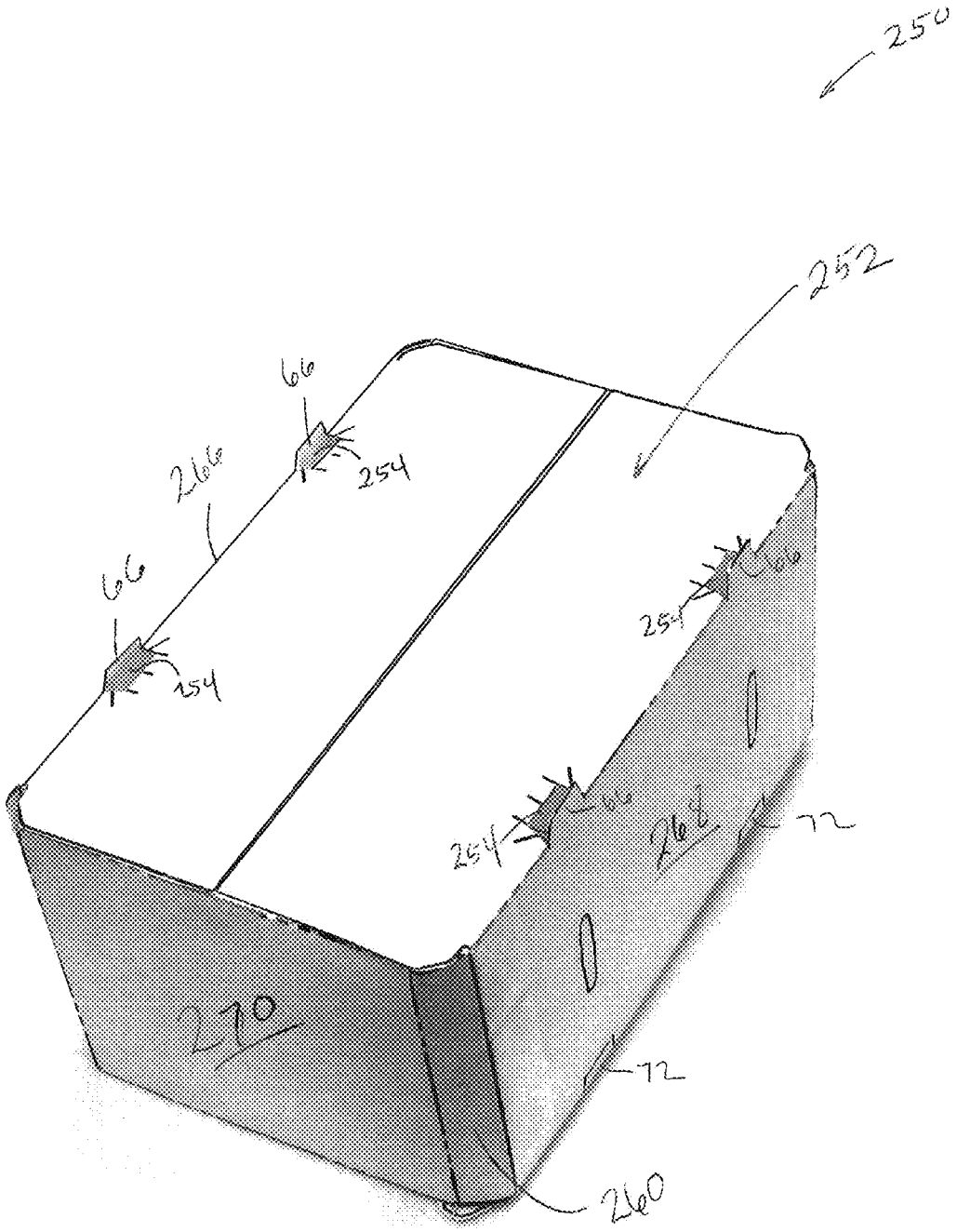
Figure 4:
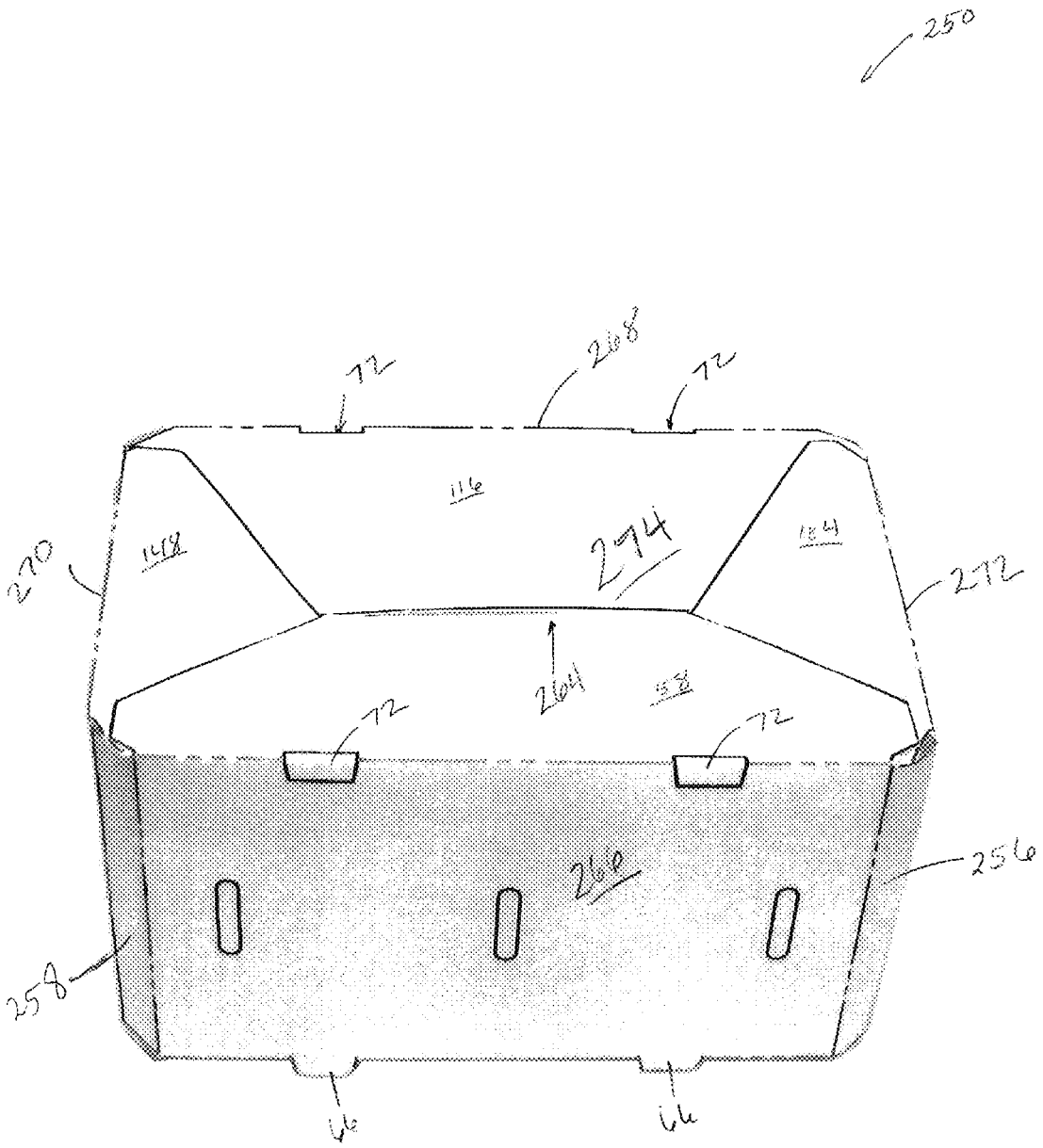

Referring now to the drawings, and more specifically to FIGS. 1-4, although as described above a container may have any suitable size, shape, and/or configuration, FIGS. 1-4 illustrate the construction or formation of one embodiment of a container. Specifically, FIG. 1 is a top plan view of an exemplary blank 10 of sheet material. FIG. 2 is a top perspective view of a container 250 formed from blank 10. FIG. 3 is a top perspective view of container 250 with a top wall 252 formed. FIG. 4 is a bottom perspective view of container 250.

Referring to FIG. 1, blank 10 has a first or interior surface 12 and an opposing second or exterior surface 14. Further, blank 10 defines a leading edge 16 and an opposing trailing edge 18. In one embodiment, blank 10 includes, from leading edge 16 to trailing edge 18, a first corner panel 20, a first side panel 22, a second corner panel 24, a first end panel 26, a third corner panel 28, a second side panel 30, a fourth corner panel 32, a second end panel 34, and a glue flap 36 coupled together along preformed, generally parallel, fold lines 38, 40, 42, 44, 46, 48, 50, and 52, respectively. In the exemplary embodiment, corner panels 20, 24, 28, and 32 are each substantially congruent; however, it should be understood that corner panels 20, 24, 28, and/or 32 can each have any suitable size, shape, and/or configuration that enables blank 10 and/or container 250 (shown in FIGS. 2-4) to function as described herein.

First corner panel 20 extends from first side panel 22 along fold line 38, second corner panel 24 extends from first side panel 22 along fold line 40, first end panel 26 extends from second corner panel 24 along fold line 42, third corner panel 28 extends from first end panel 26 along fold line 44, second side panel 30 extends from third corner panel 28 along fold line 46, fourth corner panel 32 extends from second side panel 30 along fold line 48, second end panel 34 extends from fourth corner panel 32 along fold line 50, and glue flap 36 extends from second end panel 34 along fold line 52. Fold lines 38, 40, 42, 44, 46, 48, 50, and/or 52, as well as other fold lines and/or hinge lines described herein, may include any suitable line of weakening and/or line of separation known to those skilled in the art and guided by the teachings herein provided. In the exemplary embodiment, panels 22, 26, and 30 each include vent holes 54. It should be understood that any panel and/or portion of blank 10 can include vent holes 54 having any suitable shape and/or configuration. In a particular embodiment, blank 10 does not include any vent holes 54.

First side panel 22 includes a first top side panel 56 and a first bottom side panel 58 extending therefrom along respective fold lines 60 and 62. More specifically, first top side panel 56 extends from first side panel 22 along fold line 60, and first bottom side panel 58 extends from first side panel 22 along fold line 62. In the exemplary embodiment, fold line 60 includes cut lines 64. More specifically, cut lines 64 each define a tab portion 66. When blank 10 is assembled to construct container 250, tab portions 66 extend from a top edge 68 of first side panel 22 to define openings 254 (shown in FIGS. 2-4) extending through container 250. Although cut lines 64 and tab portions 66 are shown and described as extending from fold line 60 and/or first side panel 22, fold line 60 and/or first side panel 22 is not required to include cut lines 64 and tabs portions 66. In the exemplary embodiment, fold line 62 includes cutouts 70 that define bottom vent holes 72 along a bottom edge 74 of first side panel 22 when container 250 is formed. Although cutouts 70 are shown and described as extending from fold line 62 and/or first side panel 22, fold line 62 and/or first side panel 22 is not required to include cutouts 70. In a particular embodiment, bottom vent holes 72 and tab portions 66 are configured such that, when containers 250 are stacked, tab portions 66 of a lower container 250 insert into bottom vent holes 72 of an upper container 250.

In the exemplary embodiment, first top side panel 56 is generally rectangular and has a depth $D_{11}$ that is about half of a depth $D_{12}$ (shown in FIG. 2) of container 250. First top side panel 56 has a width $W_{11}$ that is wider than a width $W_{12}$ of first side panel 22. Alternatively, first top side panel 56 has any suitable depth and/or width that enables blank 10 and/or container 250 to function as described herein. In the exemplary embodiment, first top side panel 56 includes opposing side edges 76 and 78 and a free edge 80 extending between side edges 76 and 78. A first angled edge 82 extends between fold line 60 and first side edge 76, and a second angled edge 84 extends between fold line 60 and second side edge 78. A slot 86 defined between first angled edge 82 and first corner panel 20, and slot 86 is defined between second angled edge 84 and second corner panel 24.

In the exemplary embodiment, first bottom side panel 58 has a depth $D_{13}$ that is more than about half of depth $D_{12}$ of container 250. Alternatively, first bottom side panel 58 has any suitable depth that enables blank 10 and/or container 250 to function as described herein. In the exemplary embodiment, first bottom side panel 58 includes a locking tab 88 defined by a free edge 90. Locking tab 88 has a width $W_{13}$. More specifically, free edge 90 includes a first outwardly angled portion 92, a first vertical portion 94, a first inwardly angled portion 96, a second vertical portion 98, a horizontal portion 100, a third vertical portion 102, a second inwardly angled portion 104, a fourth vertical portion 106, and a second outwardly angled portion 108. Outwardly angled portions 92 and 108 are configured based on angles of a first corner wall 256 (shown in FIGS. 2-4) and a second corner wall 258 (shown in FIGS. 2-4), respectively. First outwardly angled portion 92, first vertical portion 94, and first inwardly angled portion 96 define a first corner projection 110, and second inwardly angled portion 104, fourth vertical portion 106, and second outwardly angled portion 108 defined a second corner projection 112. Locking tab 88 is defined by second vertical portion 98, horizontal portion 100, and third vertical portion 102.

Similarly, second side panel 30 includes a second top side panel 114 and a second bottom side panel 116 extending therefrom along respective fold lines 118 and 120. More specifically, second top side panel 114 extends from second side panel 30 along fold line 118, and second bottom side panel 116 extends from second side panel 30 along fold line 120. In the exemplary embodiment, fold line 118 includes cut lines 64. More specifically, cut lines 64 each define tab portions 66, as described above. Although cut lines 64 and tab portions 66 are shown and described as extending from fold line 118 and/or second side panel 30, fold line 118 and/or second side panel 30 is not required to include cut lines 64 and tab portions 66. In the exemplary embodiment, fold line 120 includes cutouts 70 that define bottom vent holes 72 as described above, along a bottom edge 122 of second side panel 30 when container 250 is formed. Although cutouts 70 are shown and described as extending from fold line 120 and/or second side panel 30, fold line 120 and/or second side panel 30 is not required to include cutouts 70.

In the exemplary embodiment, second top side panel 114 is generally rectangular and has depth $D_{11}$. Second top side panel 114 has width $W_{11}$ that is wider than width $W_{12}$ of second side panel 30. Alternatively, second top side panel 114 has any suitable depth and/or width that enables blank 10 and/or container 250 to function as described herein. In the exemplary embodiment, second top side panel 114 is substantially similar to first top side panel 56 and includes opposing side edges 76 and 78 and free edge 80 extending between side edges 76 and 78. First angled edge 82 extends between fold line 118 and first side edge 76, and second angled edge 84 extends between fold line 118 and second side edge 78. Slot 86 defined between first angled edge 82 and third corner panel 28, and slot 86 is defined between second angled edge 84 and fourth corner panel 32.

Second bottom side panel 116 has depth $D_{13}$; however, second bottom side panel 116 can have any suitable depth that enables blank 10 and/or container 250 to function as described herein. In the exemplary embodiment, second bottom side panel 116 includes a free edge 124 that defines a locking indentation 126 having a width $W_{14}$ that is slightly wider than width $W_{13}$. In the exemplary embodiment, free edge 124 includes a first outwardly angled portion 128, a first vertical portion 130, a first horizontal portion 132, a second vertical portion 134, a second horizontal portion 136, a third vertical portion 138, a third horizontal portion 140, a fourth vertical portion 142, and a second outwardly angled portion 144. Outwardly angled portions 128 and 142 are configured based on angles of a third corner wall 260 (shown in FIGS. 2-4) and a fourth corner wall 262 (shown in FIGS. 2-4), respectively. Locking indentation 126 is defined by second vertical portion 134, second horizontal portion 136, and third vertical portion 138.

First end panel 26 includes a first top end panel 146 and a first bottom end panel 148 extending therefrom along respective fold lines 150 and 152. More specifically, first top end panel 146 extends from first end panel 26 along fold line 150, and first bottom end panel 148 extends from first end panel 26 along fold line 152. In the exemplary embodiment, first top end panel 146 is substantially rectangular and has a width $W_{15}$ that is substantially equal to a width $W_{16}$ of first end panel 26. Gaps 154 are defined between a first side edge 156 of first top end panel 146 and second side edge 78 of first top side panel 56 and between a second side edge 158 of first top end panel 146 and first side edge 76 of second top side panel 114.

First bottom end panel 148 has depth $D_{13}$; however, first bottom end panel 148 can have any suitable depth that enables blank 10 and/or container 250 to function as described herein. A free edge 160 of first bottom end panel 148 defines a first locking extension 162. More specifically, free edge 160 includes a first outwardly angled portion 164, a first vertical portion 166, a horizontal portion 168, a second vertical portion 170, an inwardly angled portion 172, a third vertical portion 174, and a second outwardly angled portion 176. Third vertical portion 174 is separated from first vertical portion 130 of second bottom side panel 116 by a cut line 178. Outwardly angled portions 164 and 176 are configured based on angles of second corner wall 258 and third corner wall 260, respectively. Second outwardly angled portion 176, third vertical portion 174, and inwardly angled portion 172 define a third corner projection 180. First locking extension 162 is defined by first vertical portion 166, horizontal portion 168, and second vertical portion 170.

Similarly, second end panel 34 includes a second top end panel 182 and a second bottom end panel 184 extending therefrom along respective fold lines 186 and 188. More specifically, second top end panel 182 extends from second end panel 34 along fold line 186, and second bottom end panel 184 extends from second end panel 34 along fold line 188. In the exemplary embodiment, second top end panel 182 is substantially similar to first top end panel 146. More specifically, second top end panel 182 is substantially rectangular and has width $W_{15}$ that is substantially equal to width $W_{16}$ of second end panel 34. Gap 154 is defined between first side edge 156 of second top end panel 182 and second side edge 78 of second top side panel 114.

In the exemplary embodiment, second bottom end panel 184 has depth $D_{13}$ and is substantially a mirror-image of first bottom end panel 148. Alternatively, second bottom end panel 184 has any suitable depth and/or configuration that enables blank 10 and/or container 250 to function as described herein. In the exemplary embodiment, a free edge 190 of second bottom end panel 184 defines a second locking extension 192. More specifically, free edge 190 includes a first outwardly angled portion 194, a first vertical portion 196, an inwardly angled portion 198, a second vertical portion 200, a horizontal portion 202, a third vertical portion 204, and a second outwardly angled portion 206. Outwardly angled portions 194 and 206 are configured based on angles of fourth corner wall 262 and first corner wall 256, respectively. First outwardly angled portion 194, first vertical portion 196, and inwardly angled portion 198 define a fourth corner projection 208. Second locking extension 192 is defined by second vertical portion 200, horizontal portion 202, and third vertical portion 204.

In the exemplary embodiment, a bottom locking mechanism 210 includes locking tab 88, locking indentation 126, and locking extensions 162 and 192. Locking indentation 126 and locking extensions 162 and 192 are configured to define a locking slot 264 (shown in FIGS. 2 and 4). Alternatively, bottom locking mechanism 210 can include any suitable components and/or configuration that enables container 250 to be formed from blank 10.

Referring to FIGS. 1-4, to construct container 250 from blank 10, first corner panel 20 is rotated about fold line 38 toward interior surface 12 of first side panel 22, first side panel 22 is rotated about fold line 40 toward interior surface 12 of second corner panel 24, second corner panel 24 is rotated about fold line 42 toward interior surface 12 of first end panel 26, first end panel 26 is rotated about fold line 44 toward interior surface 12 of third corner panel 28, third corner panel 28 is rotated about fold line 46 toward interior surface 12 of second side panel 30, second side panel 30 is rotated about fold line 48 toward interior surface 12 of fourth corner panel 32, fourth corner panel 32 is rotated about fold line 50 toward interior surface 12 of second end panel 34, and glue flap 36 is rotated about fold line 52 toward interior surface 12 of second end panel 34. In the exemplary embodiment, after rotating panels 20, 22, 24, 26, 28, 30, 32, and 34, and glue flap 36 about fold lines 38, 40, 42, 46, 48, 50, and 52, side panels 22 and 30 are substantially parallel to each other and substantially perpendicular to end panels 26 and 34; and first corner panel 20, glue flap 36, and third corner panel 28 are substantially parallel to each other and substantially perpendicular to second corner panel 24 and fourth corner panel 32. Panels 20, 22, 24, 26, 28, 30, 32, and 34, and glue flap 36 can be rotated about fold lines 38, 40, 42, 46, 48, 50, and 52 by wrapping blank 10 about a mandrel within a machine.

Once panels 20, 22, 24, 26, 28, 30, 32, and 34, and glue flap 36 are rotated about fold lines 38, 40, 42, 46, 48, 50, and 52, glue flap 36 is coupled to first corner panel 20. For example, in the exemplary embodiment, interior surface 12 of glue flap 36 is adhered to exterior surface 14 of first corner panel 20. Alternatively, exterior surface 14 of glue flap 36 is adhered to interior surface 12 of first corner panel 20. Further, although adhesive is described herein, glue flap 36 can be coupled to first corner panel 20 using any suitable fastener and/or technique. In the exemplary embodiment, once glue flap 36 is coupled to first corner panel 20, first side panel 22 forms a first side wall 266 of container 250, and second side panel 30 forms a second side wall 268 of container 250. Similarly, first end panel 26 forms a first end wall 270, and second end panel 34 forms a second end wall 272. First corner panel 20 and glue flap 36 form first corner wall 256, second corner panel 24 forms second corner wall 258, third corner panel 28 forms third corner wall 260, and fourth corner panel 32 forms fourth corner wall 262. From this configuration, partially formed container 250 can be collapsed into a knocked-down flat configuration for shipping and/or storage of container 250.

To continue construction of container 250, second bottom side panel 116 is rotated about fold line 120 toward interior surface 12 of second side panel 30 to be substantially perpendicular to second side panel 30. First bottom end panel 148 is rotated about fold line 152 toward interior surface 12 of first end panel 26 and into face-to-face relationship with second bottom side panel 116. Similarly, second bottom end panel 184 is rotated about fold line 188 toward interior surface 12 of second end panel 34 and into face-to-face relationship with second bottom side panel 116. More specifically, interior surface 12 of bottom end panels 148 and 184 is directly adjacent to and/or in direct contact with exterior surface 14 of second bottom side panel 116. Locking slot 264 is defined by locking indentation 126 and locking extensions 162 and 192.

First bottom side panel 58 is then rotated about fold line 62 toward interior surface 12 of first side panel 22. First bottom side panel 58 is rotated toward second bottom side panel 116 and bottom end panels 148 and 184 until panels 58, 116, 148, and 184 are rotated slightly upwardly into container 250. More specifically, panels 58, 116, 148, and 184 are rotated such that locking tab 88 can be inserted into locking slot 264. Once locking tab 88 is inserted into locking slot 264, panels 58, 116, 148, and 184 rotate outwardly to be substantially perpendicular to panels 20, 22, 24, 26, 28, 30, 32, and 34, and glue flap 36. When panels 58, 116, 148, and 184 are in the substantially perpendicular configuration, bottom panels 58, 116, 148, and 184 are locked together to form a bottom wall 274 of container 250. As such, bottom locking mechanism 210 interlocks bottom side panels 58 and 116 and bottom end panels 148 and 184 to form bottom wall 274 of container 250, as shown in FIG. 4. Corner walls 256, 258, 260, and 262, side walls 266 and 268, end walls 270 and 272, and bottom wall 274 define a cavity 276 of container 250. When corner walls 256, 258, 260, and 262, side walls 266 and 268, end walls 270 and 272, and bottom wall 274 are formed, container 250 is considered to be in an open configuration, as shown in FIG. 2.

To close container 250 by forming top wall 252 as shown in FIG. 3, first top end panel 146 is rotated about fold line 150 toward interior surface 12 of first end panel 26, and second top end panel 182 is rotated about fold line 186 toward interior surface 12 of second end panel 34. More specifically, after rotation, first top end panel 146 is substantially perpendicular to first end panel 26, and second top end panel 182 is substantially perpendicular to second end panel 34. First top side panel 56 is rotated about fold line 60 toward interior surface 12 of first side panel 22, and second top side panel 114 is rotated about fold line 118 toward interior surface 12 of second side panel 30. More specifically, after rotation, first top side panel 56 is substantially perpendicular to first side panel 22 and second top side panel 114 is substantially perpendicular to second side panel 30.

In the exemplary embodiment, top side panels 56 and 114 do not overlap each other when top side panels 56 and 114 are substantially parallel to bottom wall 274. Alternatively, top side panels 56 and 114 are sized such that top side panels 56 and 114 overlap each other when top side panels 56 and 114 are substantially parallel to bottom wall 274. In the exemplary embodiment, top side panels 56 and 114 rest on top end panels 146 and 182 while at least top side panels 56 and 114 are secured together using, for example, tape. As such, interior surface 12 of top side panels 56 and/or 114 is adjacent to and/or in direct contact with exterior surface 14 of top end panels 146 and 182. Top side panels 56 and 114 and top end panels 146 and 182 define top wall 252 of container 250.

Figure 5:
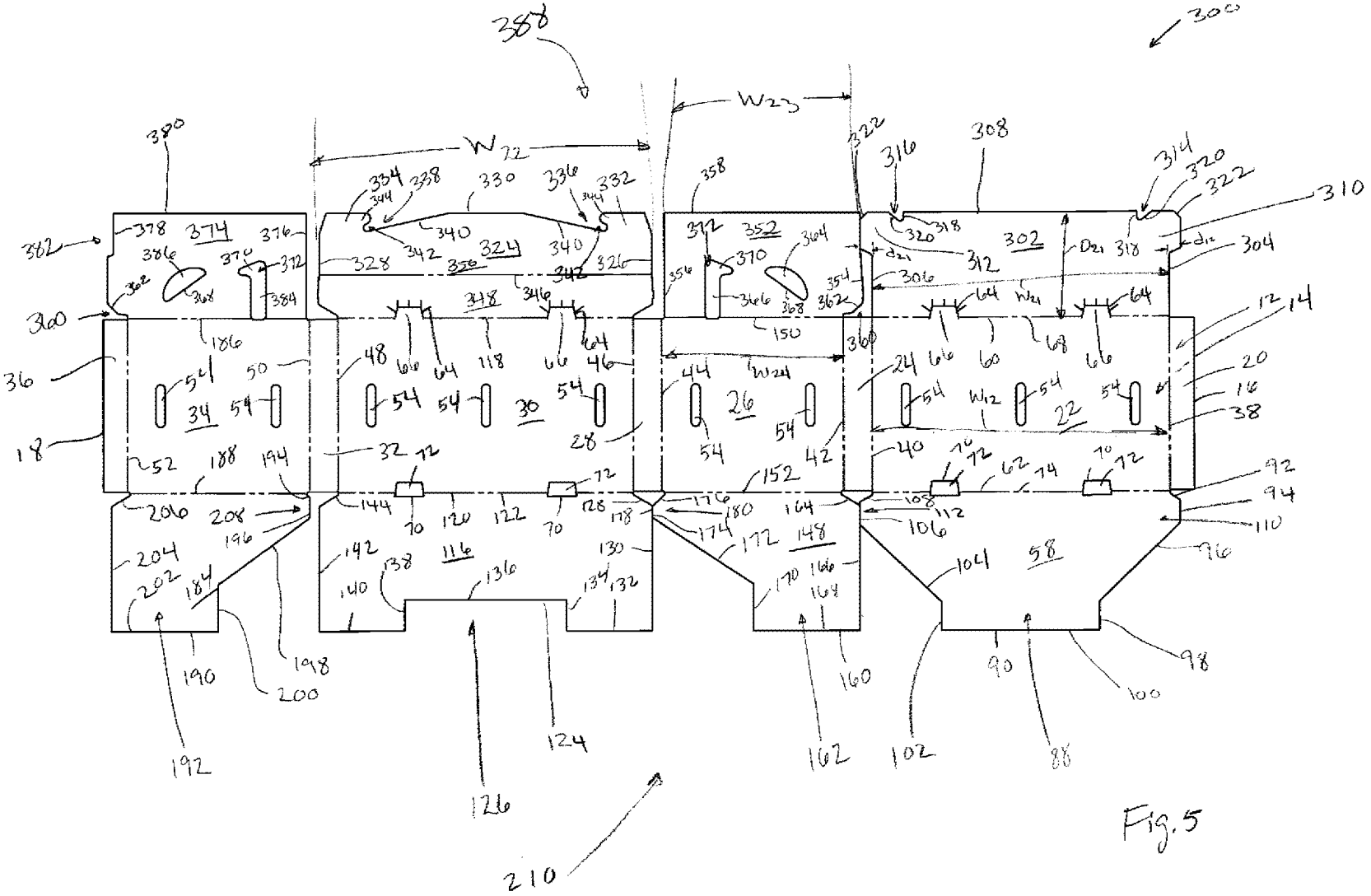
Figure 6:
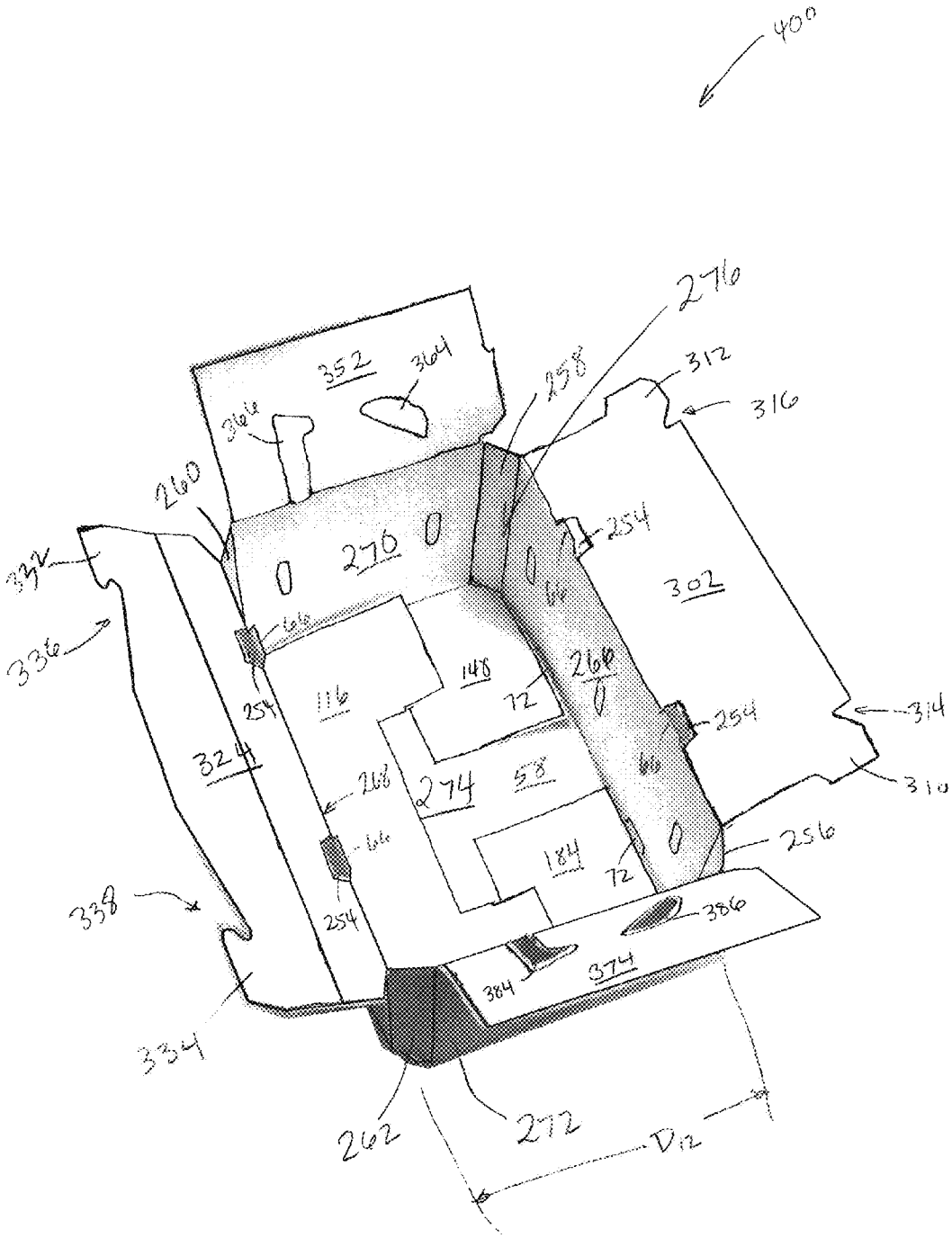
Figure 7:
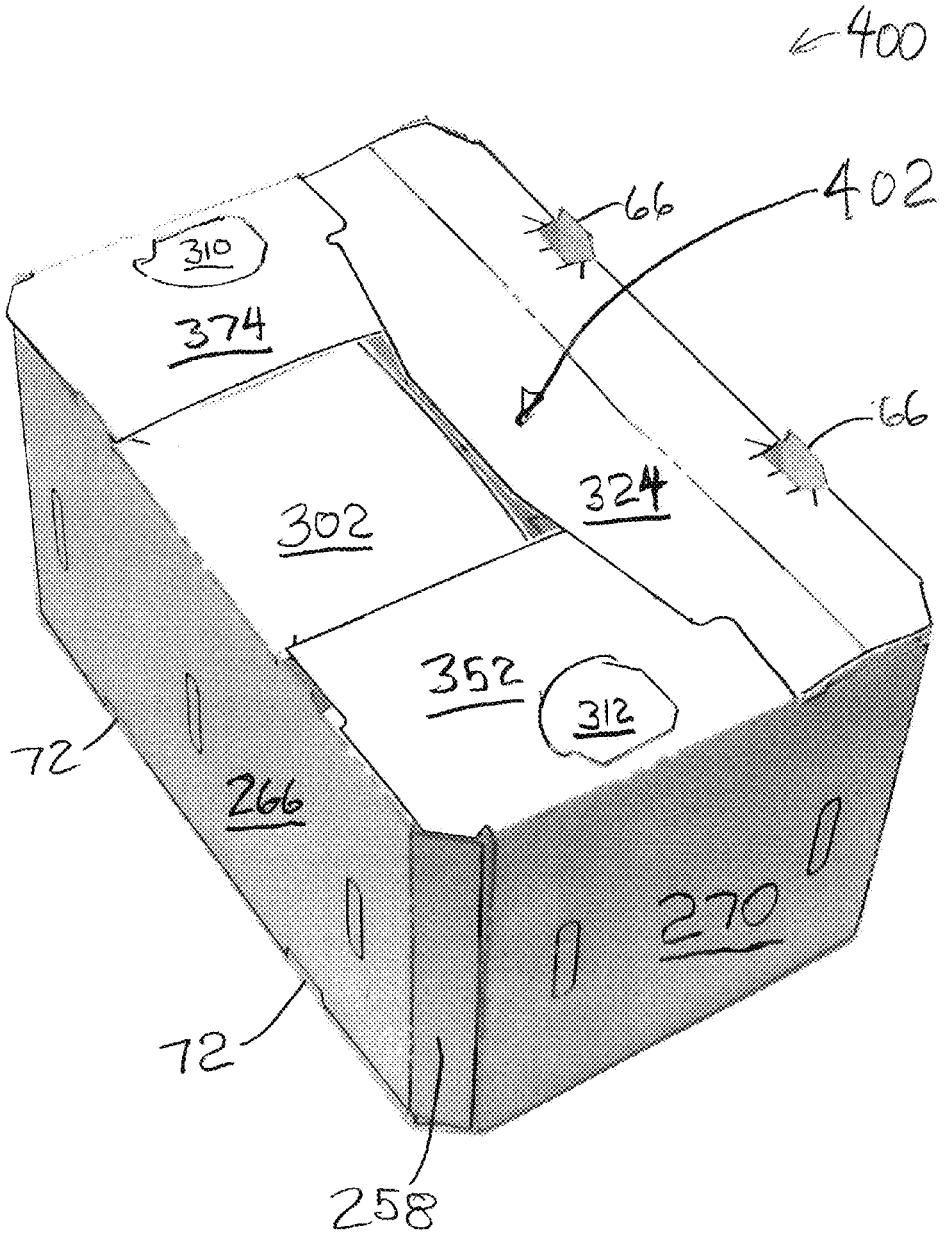

FIG. 5 is a top plan view of an exemplary blank 300 of sheet material. FIG. 6 is a top perspective view of a container 400 formed from blank 300. FIG. 7 is a top perspective view of container 400 with a top wall 402 formed. Unless otherwise described, blank 300 includes components that are similar to the components described above with reference to blank 10 (shown in FIG. 1), and container 400 includes components that are similar to the components described above with reference to container 250 (shown in FIGS. 2-4). As such, components shown in FIGS. 1-4 are labeled with similar reference numbers in FIGS. 5-7.

Referring to FIG. 5, first side panel 22 includes a first top side panel 302 and first bottom side panel 58 extending therefrom along respective fold lines 60 and 62. More specifically, first top side panel 302 extends from first side panel 22 along fold line 60. In the exemplary embodiment, first top side panel 302 is generally rectangular and has a depth $D_{21}$ that is about half of depth $D_{12}$ (shown in FIG. 6) of container 400. Alternatively, first top side panel 302 has any suitable depth width that enables blank 300 and/or container 400 to function as described herein. In the exemplary embodiment, first top side panel 302 includes opposing side edges 304 and 306 and a free edge 308 extending between side edges 304 and 306.

Free edge 308 and side edges 304 and 306 of first top side panel 302 define a first locking tab 310 and a second locking tab 312. A first notch 314 in free edge 308 at least partially defines first locking tab 310, and a second notch 316 in free edge 308 at least partially defines second locking tab 312. In the exemplary embodiment, each notch 314 and 316 includes a vertical portion 318 and an angled portion 320, and each locking tab 310 and 312 includes an angled edge 322. Further, each locking tab 310 extends outwardly a distance $d_{21}$ with respect to a width $W_{21}$ of first top side panel 302. In the exemplary embodiment, width $W_{21}$ is substantially equal to width $W_{12}$ of first side panel 22. Alternatively, locking tabs 310 and/or 312 and/or first top side panel 302 have any suitable size and/or shape that enables blank 300 and/or container 400 to function as described herein.

Similarly, second side panel 30 includes a second top side panel 324 and second bottom side panel 116 extending therefrom along respective fold lines 118 and 120. More specifically, second top side panel 324 extends from second side panel 30 along fold line 118. In the exemplary embodiment, second top side panel 324 is generally rectangular and has depth $D_{21}$. Second top side panel 324 has a width $W_{22}$ that is wider than width $W_{12}$ of second side panel 30. Alternatively, second top side panel 324 has any suitable depth and/or width that enables blank 300 and/or container 400 to function as described herein. In the exemplary embodiment, second top side panel 324 includes opposing side edges 326 and 328 and a free edge 330 extending between side edges 326 and 328.

Free edge 330 and side edges 326 and 328 of second top side panel 324 define a third locking tab 332 and a fourth locking tab 334. A third notch 336 in free edge 330 at least partially defines third locking tab 332, and a fourth notch 338 in free edge 330 at least partially defined fourth locking tab 334. In the exemplary embodiment, notches 336 and 338 are shaped differently than notches 314 and 316, and locking tabs 332 and 334 are shaped differently than locking tabs 310 and 312. More specifically, notches 336 and 338 each include an inwardly tapered portion 340 and an indention 342 that forms a projection 344 of locking tab 332 and/or 334. Further, each locking tab 332 and 334 is angled slight inward with respect to width $W_{22}$ of second top side panel 324.

In the exemplary embodiment, second top side panel 324 includes a line of weakness 346 extending across second top side panel 324 substantially parallel to fold line 118. Line of weakness 346 divides second top side panel 324 into a first portion 348 extending from fold line 118 and a second portion 350 extending from line of weakness 346 to free edge 330. In an alternative embodiment, second top side panel 324 does not include line of weakness 346.

First end panel 26 includes a first top end panel 352 and first bottom end panel 148 extending therefrom along respective fold lines 150 and 152. More specifically, first top end panel 352 extends from first end panel 26 along fold line 150. In the exemplary embodiment, first top end panel 352 is generally rectangular and has a width $W_{23}$ that is wider than a width $W_{24}$ of first end panel 26. First top end panel 352 includes opposing side edges 354 and 356 and a free edge 358 extending therebetween. First side edge 354 defines a slot 360 between first top end panel 352 and second corner panel 24 and an angled corner 362 of first top end panel 352. First side edge 354 includes a cut line separating first top end panel 352 from second locking tab 312. Further, first top end panel 352 includes a first locking slot 364 and a second locking slot 366. First locking slot 364 is semi-circular with a flat edge 368 oriented at an angle to fold line 150. Second locking slot 366 is generally oval shaped with a projection 370 extending outwardly at an upper end 372 of second locking slot 366. It should be understood that first locking slot 364 and/or second locking slot 366 can have any suitable configuration based on locking tabs 310, 312, 332, and/or 334.

Similarly, in the exemplary embodiment, second end panel 34 includes a second top end panel 374 and second bottom end panel 184 extending therefrom along respective fold lines 186 and 188. More specifically, second top end panel 374 extends from second end panel 34 along fold line 186. In the exemplary embodiment, second top end panel 374 is generally rectangular and has width $W_{23}$ that is wider than width $W_{24}$ of second end panel 34. Further, second top end panel 374 is substantially a mirror-image of first top end panel 352. More specifically, second top end panel 374 includes opposing side edges 376 and 378 and a free edge 380 extending therebetween. Second side edge 378 defines slot 360 between second top end panel 374 and glue flap 36. Second side edge 378 further defines angled corner 362 of second top end panel 374 and an indention 382 extending along second side edge 378. Further, second top end panel 374 includes a third locking slot 384 and a fourth locking slot 386. Third locking slot 384 is substantially a mirror-image of second locking slot 366, and fourth locking slot 386 is substantially a mirror-image of first locking slot 364. It should be understood that third locking slot 384 and/or fourth locking slot 386 can have any suitable configuration based on locking tabs 310, 312, 332, and/or 334.

In the exemplary embodiment, a top locking mechanism 388 includes locking tabs 310, 312, 332, and 334 and locking slots 364, 366, 384, and 386. Further, in the exemplary embodiment, panels 22, 26, 30, and 34 each include vent holes 54. It should be understood that any panel and/or portion of blank 300 can include vent holes 54 having any suitable shape and/or configuration. In a particular embodiment, blank 300 does not include any vent holes 54.

Referring to FIGS. 5-7, container 400 is constructed from blank 300 in a manner similar to constructing container 250 (shown in FIGS. 2-4) from blank 10 (shown in FIG. 1). However, to close container 400 by forming top wall 402 as shown in FIG. 7, first top side panel 302 is rotated slightly about fold line 60 toward interior surface 12 of first side panel 22. First top end panel 352 is rotated slightly about fold line 150 toward interior surface 12 of first end panel 26, and second top end panel 374 is rotated slightly about fold line 186 toward interior surface 12 of second end panel 34. First locking tab 310 is at least partially inserted into fourth locking slot 386, and second locking tab 312 is at least partially inserted into first locking slot 364. Panels 302, 352, and 374 are then pushed toward cavity 276 until first top side panel 302 is substantially perpendicular to first side panel 22, first top end panel 352 is substantially perpendicular to first end panel 26, and second top end panel 374 is substantially perpendicular to second end panel 34. In such a configuration, locking tabs 310 and 312 are inserted into locking slots 386 and 364, and notches 314 and 316 rest against an edge of each locking slot 386 or 364, respectively. Further, exterior surface 14 of first top side panel 302 is in face-to-face relationship with interior surface 12 of top end panels 352 and 374. More specifically, exterior surface 14 of first top side panel 302 is directly adjacent to and/or in direct contact with interior surface 12 of top end panels 352 and/or 374.

Alternatively, first top end panel 352 is rotated about fold line 150 toward interior surface 12 of first end panel 26, and second top end panel 374 is rotated about fold line 186 toward interior surface 12 of second end panel 34 until top end panels 352 and 374 are generally perpendicular to end panels 26 and 34. First top side panel 302 is rotated about fold line 60 toward interior surface 12 of first side panel 22 to enable locking tabs 310 and 312 to be inserted into locking slots 386 and 364. More specifically, first locking tab 310 is inserted into fourth locking slot 386, and second locking tab 312 is inserted into first locking slot 364. When locking tabs 310 and 312 are inserted into locking slots 386 and 364, notches 314 and 316 rest against an edge of each locking slot 386 or 364, respectively. Further, interior surface 12 of first top side panel 302 is in face-to-face relationship with exterior surface 14 of top end panels 352 and 374. More specifically, interior surface 12 of first top side panel 302 is directly adjacent to and/or in direct contact with exterior surface 14 of top end panels 352 and/or 374.

In the exemplary embodiment, second top side panel 324 is rotated about fold line 118 toward interior surface 12 of second side panel 30. Second portion 350 of second top side panel 324 is rotated slightly about line of weakness 346 toward interior surface 12 of first portion 348. In the exemplary embodiment, second top side panel 324 is not creased at line of weakness 346 when second portion 350 is rotated toward first portion 348. Rather, the slight rotation of second portion 350 facilitates inserting third locking tab 332 into second locking slot 366 and inserting fourth locking tab 334 into third locking slot 384. When locking tabs 332 and 334 are inserted into locking slots 366 and 384, notches 336 and 338 rest against an edge of each locking slot 366 or 384, respectively. Further, interior surface 12 of second top side panel 324 is in face-to-face relationship with exterior surface 14 of top end panels 352 and 374. More specifically, interior surface 12 of second top side panel 324 is directly adjacent to and/or in direct contact with exterior surface 14 of top end panels 352 and/or 374. In the exemplary embodiment, top locking mechanism 388 interlocks top side panels 302 and 324 with top end panels 352 and 374 to form top wall 402 of container 400, as shown in FIG. 7.

The embodiments described above provide a non-rectangular container that includes a bottom wall formed from interlocking bottom panels. The interlocking bottom panels enable the non-rectangular container to be finally formed without using adhesives. More specifically, the bottom panels securely interlock such that the bottom wall is formed without the need of glue, tape, and/or any other adhesive. As such, the containers described herein can be transported and/or stored in a knocked-down flat configuration, and erected automatically or manually without adhesive.

Further, the above-described embodiments provide a non-rectangular container that has better space efficiency, stacking strength, and/or bulge resistance as compared to rectangular containers. More specifically, the octagonal shapes of the containers described herein can provide additional strength to the container and/or greater resistance to bulge over conventional rectangular, square or even hexagonal-shaped containers. The octagonal-shaped containers described herein also provide increased stacking strength. Moreover, the containers described herein can be stacked during shipping and/or transport. For example, the above-described containers can be formed from a light-weight material and used in the upper layers of a stack of containers. The lower layers of containers can include reinforced containers and/or the above-described containers formed from a heavy-weight material.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, the methods may also be used in combination with other containers and methods, and are not limited to practice with only the containers and methods as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a polygonal container, the blank comprising:

two end panels, two side panels, and four corner panels connected in series along a plurality of fold lines, each of the four corner panels having a free bottom edge; and a plurality of bottom panels each extending from one panel of the end panels and the side panels, at least three bottom panels of the plurality of bottom panels each having a first outwardly angled portion and a first inwardly angled portion that cooperate to at least partially define a corner projection, each first outwardly angled portion is configured to extend proximate to a respective one of the free bottom edges when the container is erected such that each respective corner projection forms a portion of a bottom wall of the erected container, the plurality of bottom panels configured to define a locking slot and a locking tab that is insertable into the locking slot to form another portion of the bottom wall of the erected container.

2. A blank in accordance with claim 1, wherein the plurality of bottom panels comprises:

a first bottom end panel extending from a bottom edge of a first end panel of the two end panels;

a second bottom end panel extending from a bottom edge of a second end panel of the two end panels;

a first bottom side panel extending from a bottom edge of a first side panel of the two side panels; and a second bottom side panel extending from a bottom edge of a second side panel of the two side panels.

3. A blank in accordance with claim 2 wherein the first bottom side panel defines the locking tab.

4. A blank in accordance with claim 2 wherein the locking slot is defined by the first bottom end panel, the second bottom end panel, and the second bottom side panel.

5. A blank in accordance with claim 4 wherein the first bottom end panel defines a first locking extension; the second bottom end panel defines a second locking extension; and the second bottom side panel defines a locking indentation.

6. A blank in accordance with claim 5 wherein the first locking extension, the second locking extension, and the locking indentation are configured to define the locking slot.

7. A blank in accordance with claim 1 further comprising a plurality of top panels each extending from one panel of the end panels and the side panels, the plurality of top panels configured to form a top wall of the container.

8. A blank in accordance with claim 7 wherein the plurality of top panels are configured to interlock using tabs and slots defined by the plurality of top panels to form the top wall.

9. A blank in accordance with claim 1, wherein each first outwardly angled portion is configured to be co-linear with a respective one of the free bottom edges when the container is erected.

10. A container formed from a blank of sheet material, the container comprising:

two end walls, two side walls, and four corner walls connected in series along a plurality of fold lines, each of the four corner walls having a free bottom edge; and a bottom wall formed from a plurality of bottom panels each extending from one wall of the end walls and the side walls, at least three bottom panels of the plurality of bottom panels each having a first outwardly angled portion and a first inwardly angled portion that cooperate to at least partially define a corner projection, each first outwardly angled portion extends proximate to a respective one of the free bottom edges such that each respective corner projection forms a portion of the bottom wall of the erected container, the plurality of bottom panels configured to define a locking slot and a locking tab that is insertable into the locking slot to form another portion of the bottom wall.

11. A container in accordance with claim 10 wherein the plurality of bottom panels forming the bottom wall comprises: a first bottom end panel extending from a bottom edge of a first end wall of the two end walls; a second bottom end panel extending from a bottom edge of a second end wall of the two end walls; a first bottom side panel extending from a bottom edge of a first side wall of the two side walls; and a second bottom side panel extending from a bottom edge of a second side wall of the two side walls.

12. A container in accordance with claim 11 wherein the locking tab is defined by the first bottom side panel and the locking slot is defined by the first bottom end panel, the second bottom end panel, and the second bottom side panel.

13. A container in accordance with claim 10 further comprising a top wall formed from a plurality of top panels each extending from one panel of the end panels and the side panels.

14. A container in accordance with claim 13 wherein the top wall is formed by interlocking the plurality of top panels together using tabs and slots defined by the plurality of top panels.

15. A container in accordance with claim 10, wherein each first outwardly angled portion is co-linear with a respective one of the free bottom edges.

16. A method for forming a container from a blank of sheet material, the method comprising:

rotating a plurality of wall panels about a plurality of fold lines to form a first side wall, an opposing second side wall, a first end wall, an opposing second end wall, and a plurality of corner walls that each have a free bottom edge; and rotating a plurality of bottom panels with respect to the plurality of wall panels to form a bottom wall, the plurality of bottom panels defining a locking slot and a locking tab insertable into the locking slot, at least three bottom panels of the plurality of bottom panels each having a first outwardly angled portion and a first inwardly angled portion that cooperate to at least partially define a corner projection, each first outwardly angled portion extends proximate to a respective one of the free bottom edges when the container is erected such that each respective corner projection forms a portion of the bottom wall of the erected container.

17. A method in accordance with claim 16, wherein rotating a plurality of bottom panels with respect to the plurality of wall panels to form a bottom wall further comprises: rotating a first bottom end panel with respect to the first end wall; rotating a second bottom end panel with respect to the second end wall; rotating a first bottom side panel with respect to the first side wall; and rotating a second bottom side panel with respect to the second side wall.

18. A method in accordance with claim 17, wherein the locking tab is defined by the first bottom side panel and rotating a first bottom side panel comprises inserting the locking tab into the locking slot.

19. A method in accordance with claim 17, wherein rotating a plurality of bottom panels with respect to the plurality of wall panels to form a bottom wall further comprising defining the locking slot with the first bottom end panel, the second bottom end panel, and the second bottom side panel.

20. A method in accordance with claim 16, wherein rotating a plurality of wall panels about a plurality of fold lines further comprises forming four corner walls.

21. A method in accordance with claim 16, further comprising rotating a plurality of top panels with respect to the plurality of wall panels to form a top wall.

22. A method in accordance with claim 21, further comprising interlocking the plurality of top panels to form the top wall using slots and tabs defined by the plurality of top panels.

23. A method in accordance with claim 16, wherein rotating the plurality of bottom panels further comprises rotating the plurality of bottom panels such that each first outwardly angled portion is co-linear with a respective one of the free bottom edges.

* * * * *